United States Patent [19]

Michelson et al.

[11] Patent Number: 4,990,918

[45] Date of Patent: Feb. 5, 1991

[54] RADAR REFLECTOR TO ENHANCE RADAR DETECTION

[75] Inventors: David G. Michelson; Helmut H. Lanziner, both of North Vancouver, Canada

[73] Assignee: University of British Columbia, Vancouver, Canada

[21] Appl. No.: 455,701

[22] Filed: Dec. 21, 1989

[51] Int. Cl.[5] ..... H01Q 15/18

[52] U.S. Cl. ..... 342/7

[58] Field of Search ..... 342/7, 8, 5

[56] References Cited

U.S. PATENT DOCUMENTS

| | | | |
|---|---|---|---|
| 2,721,998 | 10/1955 | Holm | 342/8 |
| 4,195,298 | 3/1980 | Firth | 342/8 |
| 4,272,768 | 6/1981 | Rookard | 342/7 |

OTHER PUBLICATIONS

Editor: George T. Ruck, "Cross Section Handbook", vol. 2, Plenum Press 1970, pp. 588–597 plus references.

"Topics for a Statistical Description of Radar Cross Section", Maffett, John Wiley & Sons, 1989, pp. 190–201 and 359–366.

"Spatial Coverage of Radar Reflectors", pp. 83–101 of Chapter 3 of *Radar Targets* by Christian G. Bachman, Lexington Books, 1982.

Bell System Technical Journal, vol. 26, pp. 852–869, Oct. 1947 "Targets For Microwave Radar Navigation".

Southworth, G. C., "*Principles and Application of Waveguide Transmission*", D. Van Nostrand Inc., N.Y. (1950); QC 661 568; pp. 475–481.

*Primary Examiner*—Gilberto Barron, Jr.

*Attorney, Agent, or Firm*—Townsend and Townsend

[57] ABSTRACT

A radar reflector provides an enhanced radar cross section pattern in one plane and this improved radar detectability in that plane. The radar reflector comprising a trihedral corner reflector arrangement having three planar faces at right angles to each other, a first planar face substantially triangular in shape having a right angle representing a common vertex, second and third planar faces joined at inner edges of the second and third planar faces to form a center line extending from the common vertex and each joined to the first planar face at straight sides extending from the common vertex such that the reflector is symmetrical about the center line, the center line being shorter than the two straight sides.

5 Claims, 5 Drawing Sheets

TRIANGULAR
△

SQUARE
□

ASYMMETRICALLY TRUNCATED
▽

SYMMETRICALLY TRUNCATED
◇

COMPENSATED
+

EXTENDED
×

RADAR REFLECTOR TO ENHANCE RADAR DETECTION

BACKGROUND OF THE INVENTION

The present invention relates to radar reflectors used to enhance the radar cross section of fixed and moving targets. More specifically the present invention relates to an asymmetrical trihedral corner reflector to provide an enhanced radar cross section pattern in one plane, and hence enhanced radar detectability in that plane.

Radar reflectors are used to enhance the radar cross sections of vessels, landmarks, and other targets that are encountered in marine navigation. They increase the range at which such targets can be reliably detected by radar.

For many applications the trihedral corner reflector provides an ideal reflector. It presents a substantial radar cross section over a wide range of aspects while occupying a relatively small space. Trihedral corner reflectors are passive, generally mechanically rugged, and resistant to corrosion and weathering.

Radar cross section enhancement devices derived from dielectric lenses, retrodirective antenna arrays, and active transponders, each have advantages over corner reflectors in certain aspects. For example, the width of their angular response or the size of their radar cross section may be greater than a corner reflector of similar size. However, these advantages are usually offset by the relatively high initial cost of such devices, and by their need for relatively frequent maintenance and repair.

A trihedral corner reflector consists of three mutually orthogonal flat conducting panels. The lines of intersection between the three panels fall along an orthogonal set of three axes. If an edge of a panel is a segment of one of the axes, it is said to be an inner edge. Otherwise, it is referred to as an outer edge. The symmetric axis of a trihedral corner reflector is defined as that axis which makes an equal angle, namely 54.74 degrees, with each of the three mutually orthogonal axes of that reflector. Spherical coordinates are commonly used to indicate the direction of incident radiation with respect to the reflector and are usually defined with respect to the symmetric axis with azimuth corresponding to the horizontal plane and elevation corresponding to the vertical plane. The angle of incidence which provides the maximum radar cross section is referred to as the boresight. For most trihedral corner reflectors in common use, the boresight is also the axis of symmetry. The radar cross section of the reflector generally decreases as the angle of incidence with respect to symmetric axis increases. The angular interval over which the radar cross section of the reflector is at least half of its maximum value is referred to as the beamwidth of the reflector in that plane.

Most trihedral corner reflectors in use today exhibit three-fold rotation symmetry in that rotation of such a reflector about its symmetric axis in 120 degree increments yields an identical reflector. This is a consequence of all three panels or reflecting surfaces having exactly the same shape. The shapes of the panels in commonly used trihedral corner reflectors generally fall into three categories, triangular, semicircular, and square, with slight variations. Triangular corner reflectors are the most common. In all these cases, each panel or reflecting surface exhibits a mirror plane or two-fold inversion symmetry about a line which bisects the right angle formed by its two inner edges. As a result all six inner edges of all three panels are identical in length. This dimension is referred to as the corner length. It is found that symmetrical trihedral corner reflectors with identical corner lengths have nearly identical azimuthal and elevation beam widths. Comparing different symmetrical reflectors with identical corner lengths, it is generally found that an increase in the radar cross section along the symmetric axis is obtained at the expense of azimuthal beamwidth, or alternatively, an increase in the aximuthal beamwidth is obtained at the expense of the radar cross section along the symmetric axis. Typical results are shown in the following table. Robertson's reflector refers to a design presented by Robertson, Sloan D. ("Targets for Microwave Radar Navigation."-]Bell System Technical Journal, Vol. 26, pp. 852–869, Oct. 1947) in which truncation and compensation are used to improve the azimuthal and elevation response of a symmetric trihedral corner reflector but at the expense of the boresight response.

| Type | Relative Maximum RCS | Angular Beam Width |
|---|---|---|
| square | 9 | 25° |
| circular | 4 | 32° |
| triangular | 1 | 40° |
| Robertson's | 0.25 | 60° |

In conventional marine radar systems used simply to prevent vessels grounding or colliding, it is sufficient to merely detect targets of interest, including vessels, land masses and navigation hazards. However, in radar assisted navigation and positioning systems used to precisely determine the location of a vessel with respect to know landmarks, one must identify as well as detect the reference targets that have been previously placed in known and surveyed locations and one must be able to distinguish them from other targets or background clutter. It is desirable for the reference targets to have the largest possible radar cross section in order to ensure that users can successfully identify them. However, a reflector intended for use in such a radar associated positioning system must not be so large or bulky as to be difficult to handle or manufacture, and should be one that requires minimum maintenance. The radar reflector should return as large a signal as possible over the largest range of azimuthal angles possible. However, the elevation response of radar reflectors used in marine applications need not be very wide because the horizontal distance from the reflector to the antenna of the interrogating radar is usually far greater than the difference in height between them, and the depression angle between the reflector and the antenna of the interrogating radar is usually small as a consequence.

SUMMARY OF THE INVENTION

It is an aim of the present invention to provide a method for asymmetrically truncating and compensating reflector panels so that they form a triangular trihedral corner reflector in such a way that the radar cross section in the azimuth plane is enhanced compared to a triangular trihedral corner reflector of similar size and volume. It is a further aim to reduce the size of the reflector by truncating or removing sections of the reflector in such a way that the elevation response may be reduced but the azimuthal response is relatively unaffected. The face of the reflector is planar to facilitate addition of a radar-transparent dielectric cover or random to reduce windage and to protect the inside surface of the reflector from the effects of a harsh environment if necessary. The reflector can easily be mounted on a flat surface or platform with its boresight aimed in the desired direction and without the need for additional stands and supporting structure.

The present invention differs from previous reflectors in that truncation is used to sacrifice its elevation response in order to reduce its size and weight while compensation is used to increase the radar cross section in the azimuthal plane. Furthermore it is an aim to provide a radar reflector that supports itself with the boresight aimed in the desired direction without the ned for additional mounting towers or platforms.

The present invention provides a radar reflector which is asymmetric, i.e., exhibits only one-fold symmetry about its symmetric axis, and which provides increased response in one plane, generally the horizontal or azimuthal plane, as against the other plane, generally the vertical or elevation plane.

The present invention provides a radar reflector to enhance radar detection comprising a trihedral corner reflector arrangement having three planar faces at right angles to each other, a first planar face substantially triangular in shape having a right angle representing a common vertex, second and third planar faces joined at inner edges of the second and third planar faces to form a center line extending from the common vertex and each joined to the first planar face at straight sides extending from the common vertex such that the reflector is symmetrical about the center line, the center line being shorter than the two straight sides.

BRIEF DESCRIPTION OF THE DRAWINGS

In drawings which illustrate embodiments of the invention,

FIG. 7 shows an exploded view of the compensated trihedral corner reflector shown in FIG. 5.

FIG. 8 shows an isometric view of the compensated trihedral corner reflector of the type shown in FIG. 5.

FIG. 9 shows a front view of the compensated trihedral corner reflector of the type shown in FIG. 5 with the triangular panel upwards.

FIG. 10 shows an isometric view of two compensated trihedral corner reflectors mounted one above the other to achieve space diversity.

FIGS. 11 and 12 are graphs of radar cross section versus azimuth angle and elevation angle for different types of radar reflectors depicted in FIGS. 1 through 8.

DETAILED DESCRIPTION OF THE INVENTION

Figures 1, 2, 3, 4, 5, 6:
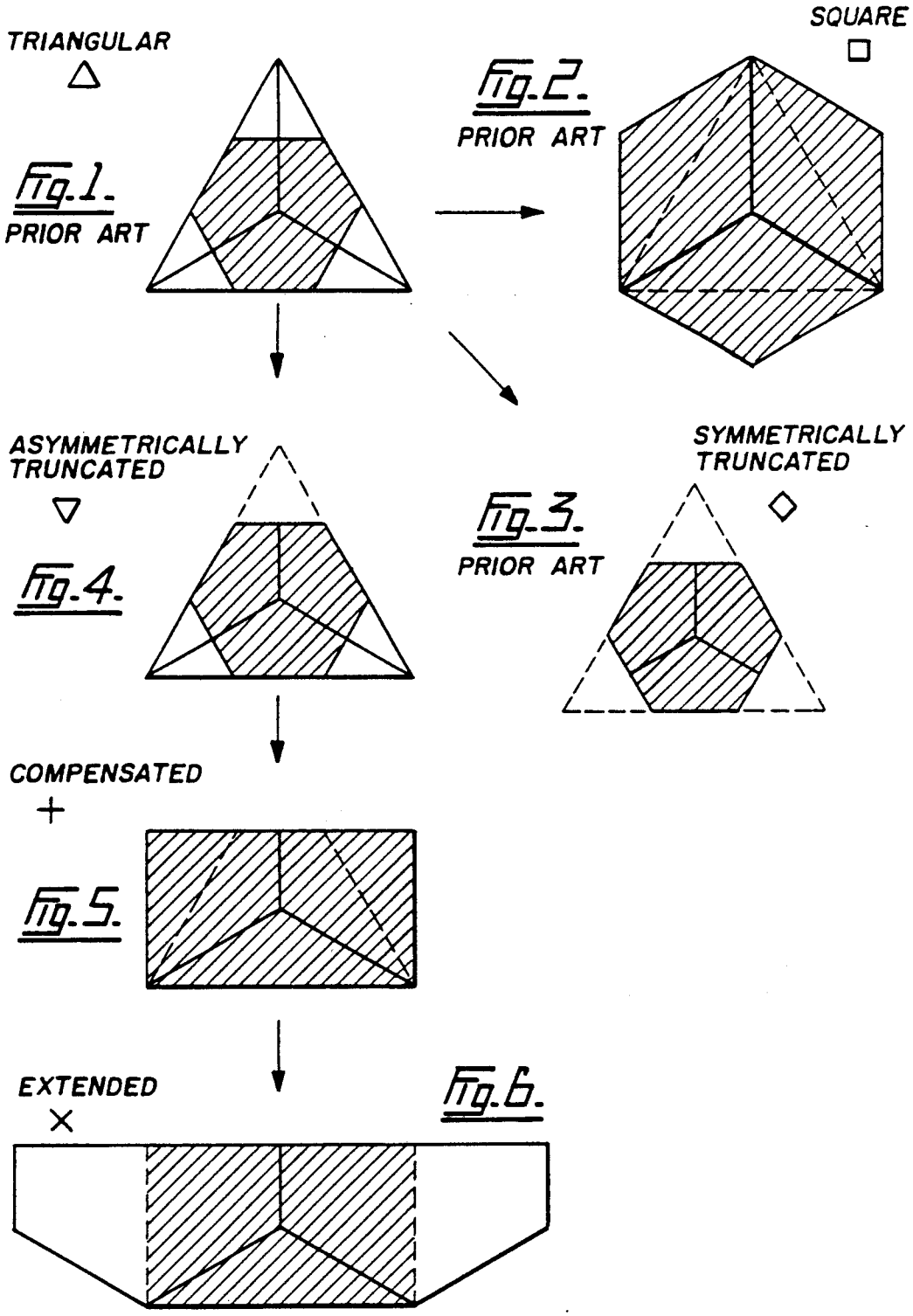
Fig. 1. PRIOR ART
Fig. 2. PRIOR ART
Fig. 3. PRIOR ART
FIG. 1 shows diagrammatically a triangular trihedral corner reflector of the type known in the prior art.
FIG. 2 shows diagrammatically a square trihedral corner reflector of the type known in the prior art.
FIG. 3 shows diagrammatically a symmetrically truncated trihedral corner reflector of the type known in the prior art.
FIG. 4 shows diagrammatically an asymmetrically truncated trihedral corner radar reflector according to one embodiment of the present invention.
FIG. 5 shows diagrammatically an asymmetrically compensated trihedral corner reflector according to another embodiment of the present invention.
FIG. 6 shows diagrammatically an asymmetrical corner reflector of the type shown in FIG. 5 with extended side panels.

FIGS. 1, 2, and 3 show typical trihedral corner radar reflectors of the type presently used in the prior art which are all symmetrical. The shaded portions represent the portions of the reflectors that return the incident wave back to the transmitter when the reflectors are illuminated along their respective symmetric axis. FIG. 1 shows a triangular trihedral corner reflector with three identical isosceles right triangular sides. Considering the effective echoing area represented by the shaded portions of FIG. 2, it can be seen that the aperture efficiency of a triangular corner reflector is about 66% when it is illuminated along its symmetrical axis. FIG. 2 shows a square trihedral corner reflector with the dotted lines representing the reflector area of FIG. 1. FIG. 3 shows a symmetrical truncated trihedral reflector with the dotted lines representing the reflector area of FIG. 1.

FIG. 4 shows how the asymmetrically truncated trihedral corner reflector according to one embodiment of the present invention is derived form the known symmetrical triangular trihedral corner reflector. The shaded area represents the portion of the reflector that returns the incident wave back to the transmitter when viewed along the boresight and the dotted lines represent the reflector area of FIG. 1 which is removed.

FIG. 5 illustrates a compensated trihedral corner reflector of the present invention, details of which will be described later. The dotted lines represent the reflector area of FIG. 4. FIG. 6 illustrates the extended radar reflector which is an extension of the compensated reflector shown in FIG. 5 as shown in the dotted lines.

The compensated trihedral corner reflector is shown in more detail in FIGS. 7 and 8 wherein a first triangular panel 10 has a right angle 12 which when joined with the other panels represents the center or common vertex of the reflector. The two sides 14 of the triangular panel 12 extend at right angles from each other. The front side 16 is the open edge of the reflector. Two side panels 18 are shown trapezoidal in shape with a right angle 20 at the corner which joins to the center 12 or right angle of the first panel 10. A center line 22 is formed by the two inner edges of the adjoining sides of the trapezoidal figure 18 extending from the right angle 20. The lower sides 24 of the trapezoidal panels 18 join to the sides 14 of the triangular panel 10 at a right angle between the trapezoidal panels 18 and the triangular panel 10 as well as having a right angle between the two trapezoidal panels 18 at the center line 22.

The trapezoidal panels 18 have an outside edge 26 which in the embodiment shown is parallel to the center line 22. The other side 28 of the trapezoidal panels 18, which represents an open side, may have a cover extending there across which acts as a protective surface to reduce windage. Due to its position and orientation, the cover neither contributes to nor detracts from the radar cross section of the reflector regardless of whether it is made of a dielectric or conducting material. A further dielectric panel, transparent to radar signals may be placed over the front of the reflector to reduce windage and prevent build up of snow or ice. Alternatively the reflector may be place din a dome or other type of skin which is also transparent to radar signals.

FIG. 9 illustrates the reflector shown in FIGS. 7 and 8 with the triangular portion 10 uppermost. FIG. 9 shows the reflector mounted on a horizontal surface with the edges 28 of the two trapezoidal panels 18 on a horizontal surface.

FIG. 10 illustrates two compensated trihedral corner reflectors of the type shown in FIG. 5 mounted one above the other in a common housing and supported by strut 30 so as to achieve space diversity to reduce multipath fading. Nulls or range holes can occur when direct rays and rays reflected from the surface of the land, water or other obstacle intermediate between the radar and the target, are exactly 180° out of phase and are of similar magnitude. The addition of a second reflector near the first reflector but at a different height reduces the multipath fading since direct and reflected rays are not often 180° out of phase for both reflectors at the same time. The geometry of the compensated trihedral corner reflector lends itself to combining two reflectors into one unit as shown in FIG. 10.

In considering the manner by which trihedral corner reflectors return incident signals back toward the transmitter, it is noted that the signal must be reflected by each of the three conducting panels in turn if it is to be reflected back to the source except in the special cases where the angle of incidence is either normal to or parallel to one of the conducting panels. In tracing the path taken by the incident signal in the general case of oblique incidence, it is found that a ray reflected by one panel must necessarily intersect the plane of a second panel but it need not intersect that region of the plane which is occupied by the second panel. Similarly, reflection by a second panel into the plane of a third panel does not guarantee reflection by the third panel. Thus the effective flat plate echoing area of a trihedral corner reflector will vary according to the angle of incidence and the geometry of the reflector.

Tests were made to determine the effective flat plate echoing area A for different configurations of radar reflectors. The tests were performed by using an optical model that presented an aperture when a light was projected from any direction. An optical model was obtained by cutting appropriate openings in three mutually orthogonal opaque sheets, the openings representing the different shapes of the radar reflectors to produce both symmetrical and asymmetrical designs.

In a physical realization of the model, the model presents an effective aperture whose projected area is A when viewed from a given direction. Rays blocked by obstructions in the aperture correspond to reflected rays which intersect the plane of a reflector panel but not the panel itself during one or more of the three bounces that must be traversed in order for the incident ray to return to its source.

By the use of computer graphic techniques and algorithms, numbers were obtained representing the effective echoing areas for various trihedral corner reflectors over a range of aspects in the azimuthal and elevation planes. The procedures involved defining the aperture polygons as lists of points, projecting these polygons onto a view plane which is orthogonal to the angle of incidence and which passes through the common vertex of the reflector, and clipping the three projected polygons against each other to yield a single projected polygon which corresponded to the effective aperture and whose area was the desired result. By the nature of the technique, only the dominant three-bounce reflection mechanism was accounted for. The relatively minor contributions of two-bounce reflections, single-bounce reflections and edge diffraction effects were ignored.

The radar cross section of the six reflector configurations shown in FIGS. 1 through 6, namely triangular, square, symmetrically truncated, asymmetrically truncated, compensated, and extended trihedral corner reflectors, were determined using the numerical technique described above. The variations of radar cross section with angle in the azimuthal and elevation planes are compared in FIGS. 11 and 12, respectively. The symbols adjacent FIGS. 1 to 6 correspond to the symbols in the graphs to distinguish each reflector's radar cross section pattern from the others. In all cases, the corner length of the triangular trihedral corner reflector from which each reflector was derived is 1 meter. The radar cross section is calculated for a frequency of 9.445 GHz or wavelength $\lambda$ of 3.18 cm and is expressed in decibels reference to a square meter (dBsm). Radar cross section $\sigma$ is related to effective echoing area A by the formula:

$$\sigma = \frac{4\pi A^2}{\lambda^2}$$

As can be seen, the asymmetric shapes provide at least as good if not better a radar cross section in one plane, namely the azimuth plane, as the triangular trihedral reflector does. The elevation angle is not symmetrical for the asymmetric reflectors. The extended configuration clearly gives the broadest radar cross section response in the azimuth plane. The asymmetric reflectors themselves are smaller than the corresponding symmetrical reflectors.

Although the invention is intended primarily for use in marine radar navigation, it could find us in any application involving radar and radar-like systems including sonar where the special qualities of the invention as described in this disclosure are desirable. Various changes can be made to the embodiments shown herein without departing from the scope of the present invention which is limited only by the following claims.

The embodiments of the present invention in which an exclusive property or privilege is claimed are defined as follows:

1. A radar reflector to enhance radar detection in one plane comprising a trihedral corner reflector arrangement having three planar faces at right angles to each other, a first planar face substantially triangular in shape having a right angle representing a common vertex, second and third planar faces joined at inner edges of the second and third planar faces to form a center line extending from the common vertex and each joined to the first planar face at straight sides extending from the common vertex such that the reflector is symmetrical about the center line, the center line being shorter than the two straight sides, the trihedral corner reflector arrangement being rotationally asymmetric about a boresight which makes equal angles with each of the three planar faces, the shape of the planar faces being such that radar cross section response in a first plane containing the boresight and being perpendicular to the center line is greater than radar cross section response in a second plane containing the boresight and the center line, and the reflector arrangement mountable on a surface without need for additional supporting structure.

2. The radar reflector according to claim 1 wherein the second and third planar faces each have a right angle at the common vertex and form a trapezium.

3. The radar reflector according to claim 1 wherein the second and third planar faces each have a right angle at the common vertex and form a trapezoid with the center line parallel to the opposite side.

4. The radar reflector according to claim 1 wherein the second and third planar faces each have a right angle at the common vertex and form a five sided shape extending out beyond the first planar face such that radar cross section response in the first plane is greater than radar cross section response in the second plane.

5. The radar reflector according to claim 1 wherein two radar reflectors are arranged adjacent each other to achieve space diversity.

* * * * *